US006032796A

United States Patent [19]

Hopper et al.

[11] Patent Number: 6,032,796

[45] Date of Patent: Mar. 7, 2000

[54] TOOL HOLDER

[75] Inventors: Ryan Keith Hopper, Lincoln; Steven Edward Zlomke, Beatrice, both of Nebr.

[73] Assignee: American Tool Companies, Inc., Hoffman Estates, Ill.

[21] Appl. No.: 09/036,353

[22] Filed: Mar. 6, 1998

[51] Int. Cl.[7] ..... B65D 85/20

[52] U.S. Cl. ..... 206/377; 206/472; 220/4.21

[58] Field of Search ..... 206/372, 373, 206/376, 377, 379, 472, 473; 220/831, 832, 833, 834, 835, 840, 842, 4.21, 4.22, 4.24

[56] References Cited

U.S. PATENT DOCUMENTS

| | | | |
|---|---|---|---|
| D. 342,433 | 12/1993 | Sorensen . | |
| D. 378,797 | 4/1997 | Poremba et al. . | |
| D. 383,048 | 9/1997 | Sorensen et al. . | |
| D. 385,767 | 11/1997 | Sorensen et al. . | |
| 405,613 | 6/1889 | Sperry | 206/379 |
| 2,786,380 | 3/1957 | Rolland . | |
| 2,810,472 | 10/1957 | Midkiff . | |
| 2,844,244 | 7/1958 | Hanson | 206/379 |
| 2,851,915 | 9/1958 | Martinez . | |
| 3,018,876 | 1/1962 | Huot . | |
| 3,592,086 | 7/1971 | Derwin . | |
| 4,043,230 | 8/1977 | Scrivens . | |
| 4,269,311 | 5/1981 | Rich . | |
| 4,887,747 | 12/1989 | Ostrowsky et al. | 220/832 X |
| 4,914,781 | 4/1990 | Sokn et al. | 220/832 X |
| 5,248,030 | 9/1993 | Tarozzi . | |
| 5,320,232 | 6/1994 | Maguire et al. | 220/832 X |
| 5,394,984 | 3/1995 | Aiba . | |
| 5,447,232 | 9/1995 | Chow | 206/376 X |

OTHER PUBLICATIONS

"Catalog —American Tool Companies, Inc.," advertisement of American Tool Companies, Inc., pp. 4–1 through 4–5 and 4–9. It is believed that the catalog was published in Oct. of 1997.

*Primary Examiner*—Jacob K. Ackun
*Attorney, Agent, or Firm*—Brinks Hofer Gilson & Lione

[57] ABSTRACT

A tool holder having a first panel that has a first side and a second side that faces opposite to the first side, wherein the first side has a channel. The second side includes an indicating mechanism which indicates when an object will be held in place within the channel.

43 Claims, 5 Drawing Sheets

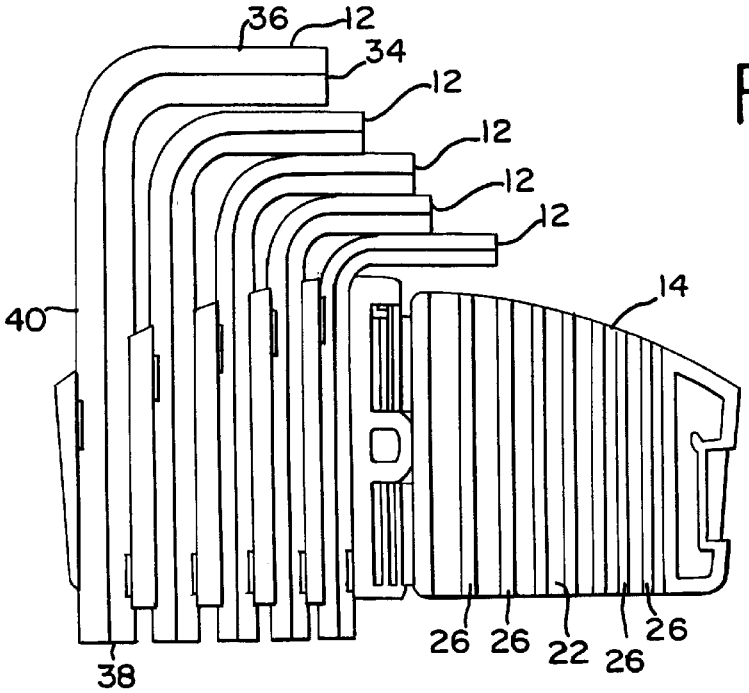
FIG. 1
FIG. 2
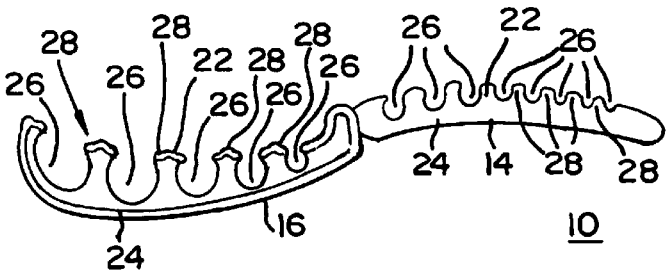
FIG. 3
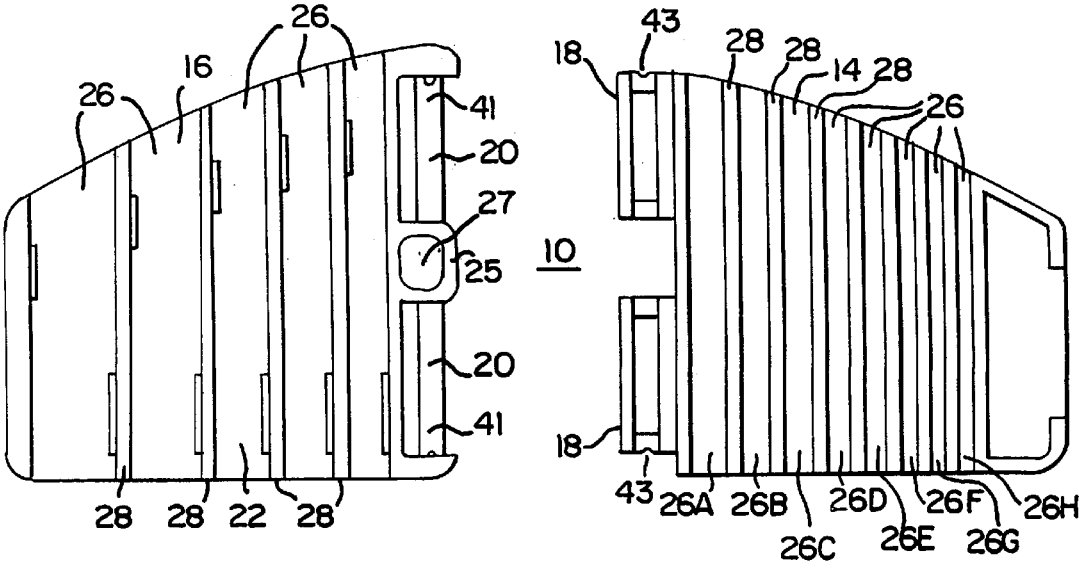

TOOL HOLDER

BACKGROUND OF THE INVENTION

Field Of The Invention

This invention relates in part to a method and apparatus for holding a tool, such as an L-key.

Discussion Of Related Art

Tool holders for holding tools, such as wrenches, are well known in the art. For example, U.S. Pat. No. 2,810,472 describes a wrench holder with a plurality of openings to receive different sized wrenches. The wrenches have to be inserted through the holes which can make it difficult to insert and remove the wrenches from the holder. In addition, there is no easy way to identify whether a tool will fit into an opening other than trial and error. In addition, the tool holder of the '472 patent is inflexible in design since its only purpose is to hold the wrenches and does not aid in the operation of the wrench.

SUMMARY OF THE INVENTION

One aspect of the present invention concerns a tool holder having a first panel with a first side and a second side that faces opposite to the first side, wherein the first side has a first open channel extending along a first direction and having a first diameter as measured perpendicular to the first direction. The first side includes a second channel having a second diameter that is different in magnitude than the first diameter.

A second aspect of the present invention regards a tool holder having a first panel with a first open channel extending along a first direction. A second panel is attached to the first panel and having a second open channel, wherein the first and second open channels have openings that face in directions opposite from one another.

A third aspect of the present invention regards a tool holder having a first panel that has a first side and a second side that faces opposite to the first side, wherein the first side has a channel. The second side includes an indicating mechanism which indicates where an object will be held in place within the channel.

A fourth aspect of the present invention regards a method of storing an object that includes the steps of providing a panel with a first side and a second side that faces opposite to the first side, wherein the first side has one or more channels and wherein the second side has one or more indicating mechanisms that correspond to the one or more channels. The method further includes the steps of placing the object adjacent to one of the one or more indicating mechanisms to determine if the indicating mechanism matches a predetermined feature of the object and placing the object within the channel that corresponds to the indicating mechanism that matches the predetermined feature of the object.

A fifth aspect of the present invention regards a tool handle to be connected to an L-shaped tool that has a first leg attached to second leg. The tool handle includes a base with an opening extending therethrough along an axis and a clamping mechanism that slides along a first direction towards the opening.

A sixth aspect of the present invention regards a tool holder that includes a first panel with a hinge, a second panel with a post which is inserted into the hinge so that the first panel pivots about the post from an open position to a closed position and a locking mechanism that is attached to the post and which engages the first panel at the closed position.

Each of the first four and sixth aspects of the present invention provides improved storage and access to a tool.

Each of the third and fourth aspects of the present invention provides improved identification of where a tool should be stored in a tool holder.

The fifth aspect of the present invention provides an improved handle for holding and locking a tool attached thereto.

The foregoing features and advantages of the present invention will be further understood upon consideration of the following detailed description of the invention taken in conjunction with the accompanying drawings, in which:

BRIEF DESCRIPTION OF THE DRAWINGS

FIG. 1 shows an interior open side view of an embodiment of a tool holder according to the present invention;

FIG. 2 shows a bottom view of the tool holder of FIG. 1 when the tools are absent;

FIG. 3 shows an exploded view of the tool holder of FIG. 1 when the tools are absent;

DESCRIPTION OF THE PREFERRED EMBODIMENT

Figure 4:
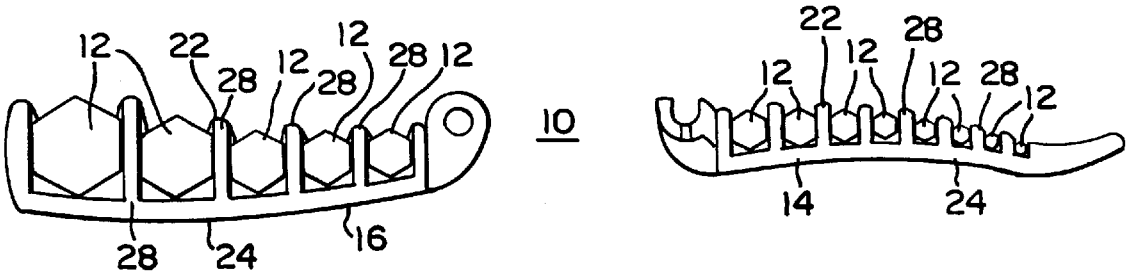
FIG. 4 shows a bottom exploded view of the tool holder of FIG. 1 when tools are present.

Referring now to the drawings wherein like reference characters designate identical or corresponding parts throughout the several figures, and in particular FIGS. 1–15 show a tool holder 10 that is designed to store one or more tools, such as L-keys 12. As shown in FIGS. 1–5, one embodiment of the tool holder 10 has a pair of panels 14, 16 that are hingedly attached to one another via a pair of C-shaped hinges 18 that are integrally attached to the panel 14. A pair of corresponding cylindrical posts 20 attached to the panel 16 are inserted into the openings formed by the hinges 18 so that the panel 14 is able to pivot about the posts 20. A handle 21 has a hook 23 integrally attached thereto that allows the handle to be attached to the panel 16 by snap locking the hook 23 onto an edge 25 of the hang hole 27 formed in the panel 16. The hang hole 27 allows the tool holder to be hung from a peg or the like. Thus, the panel 14 is able to pivot relative to the panel 16 from the open position of FIGS. 1–2 to the closed position of FIGS. 5–7 and vice versa.

Panels 14 and 16 are each trapezoidal in shape and are made of a durable material like the thermoplastic sold by Monsanto under the trademark SANTOPRENE or other thermoplastics such as polypropylene or nylon. The panels 14 and 16 may also be made by the process of reaction injection molding. Each panel 14, 16 has an interior side 22 and an exterior side 24 that faces opposite to the interior side 22. As shown in FIGS. 1–5 and 7, panels 14 and 16 each have a plurality of open channels 26 that are formed in the interior sides 22 so that each open channel 26 extends along a vertical direction and the open channels 26 are parallel to one another. Each open channel 26 has a circumference that is omega-shaped so that an L-key 12 is snap fit into the open channel. Preferably, no two open channels 26 have a diameter with the same magnitude as measured perpendicular to the vertical direction. The diameters of the open channels 26 can have a wide variety of values, such as approximately 0.050" for the panel 14 and approximately 0.375" for the panel 16. Of course, the diameters can be chosen to hold standard metric sized tools and also like round stock tools made under the TORX trademark.

Figure 6:
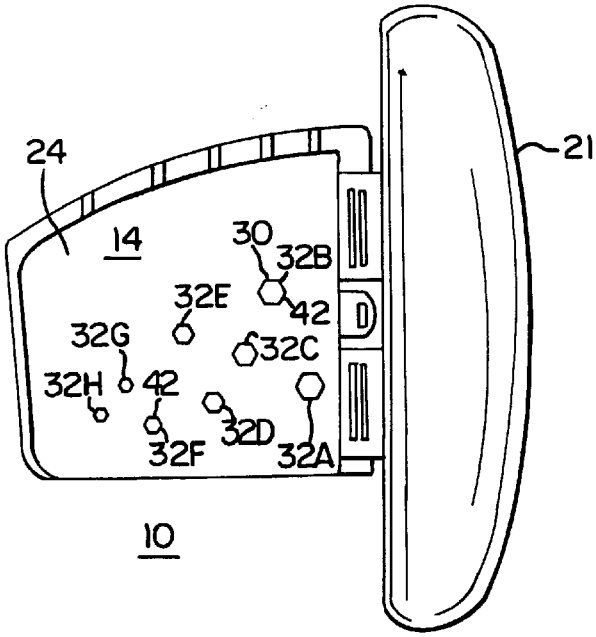
FIG. 6 shows an exterior side view of the tool holder of FIG. 1 when attached to a handle and when in a closed position.
Figure 7:
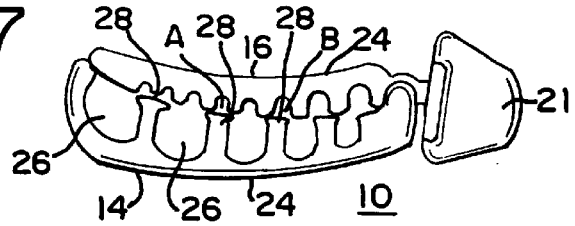
FIG. 7 shows a bottom view of the tool holder of FIG. 6.

As shown in FIGS. 6 and 7, the panel 14 can rotate relative to the panel 16 to a closed position where the exterior sides 24 of the panels 14 and 16 are substantially parallel to one another. At the closed position, the open channels 26 of the panel 14 face in a direction opposite from the direction in which the channels 26 of the panel 16 face. As shown in FIG. 7, some of the openings of the open channels 26 of the panel 14 face some of the openings 26 of the panel 16 while one or more of openings of the open channel 26 are offset relative to any of the openings of the open channels of the panel 16. When an open channel 26 of a panel 14 or 16 is offset, such as those identified as A and B in FIG. 7, the entire portion of the open channel 26 faces a rib 28 that is interposed between and formed adjacent to two adjacent open channels 26 of the other panel.

As shown in FIG. 6, the panel 14 has one or more indicating mechanisms 30 which indicate where a particular object, tool or L-key 12 will be held in place within a channel 26 formed in the panel 14. The indicating mechanisms 30 includes a plurality of polygonal protrusions such as the hexagonal shaped protrusions 32 that extend away from the exterior side 24 of the panel 14. Each protrusion 32 is made of a durable material, like the thermoplastic sold by Monsanto under the trademark SANTOPRENE or other thermoplastics such as polypropylene or nylon and is positioned opposite to an open channel 26 of the panel 14 so that there is a one-to-one correspondence between each protrusion 32 (labeled 32A–32H) and open channel 26 (labeled 26A–26H). The protrusions 32 may also be made by the process of reaction injection molding. With the protrusions 32 in place, an L-key hex wrench 12 is placed adjacent to one of the protrusions, such as protrusion 32B, to determine if the protrusion 32B matches a predetermined feature of the L-key 12, such as its length or cross-section. In the case of hexagonally shaped protrusions 32, as shown in FIG. 6, either the hexagonal face 34 of the short leg 36 or the hexagonal face 38 of the long leg 40 is placed adjacent to the hexagonal face 42 of one of the protrusions 32, such as protrusion 32B, to determine if the shape of the face 34 or 38 matches the shape of the face 42 of the protrusion 32B. If there is a match, then the user has learned that the open channel 26B that corresponds to the protrusion 32B has the appropriate size to hold the L-key 12 and then the user places the L-key within the open channel 26B that corresponds to the protrusion 32B. If there is no match, then the user keeps testing other protrusions 32 until there is a match. When there is a match, the L-key is placed in the channel 26 that corresponds to the protrusion 32 that was matched. The above-described method of determining which open channel 26 the L-key 12 is to be inserted can be extended to the panel 16 as well by attaching hexagonal shaped protrusions 32 to the exterior side 24 of the panel 16. As with panel 14, the protrusions 32 extend away from the exterior side 24 of the panel 16 and are positioned opposite to an open channel 26 of the panel 16 so that there is a one-to-one correspondence between each protrusion 32 and open channel 26 of the panel 16. It should be understood that other variations of the indicating mechanisms 30 are possible. For example, the protrusions 32 can be replaced by hexagonal indentations that extend into the exterior sides 24 of the panels 14 and 16. A match is indicated when the faces 34 or 38 of the L-key snugly fit within an indentation. The above described identification process can be extended to matching the length of the long leg 40 of the L-key 12 with linear protrusions or indentations formed in the panels 14 and 16 which represent the various lengths of the long legs of an L-key. Another variation is to place indicia, such as "1/32" or "1/16", adjacent to a slot that is designed to hold an L-key of the size identified by the indicia. Once a match is made, the L-key is inserted into the channel 26 that corresponds to the matched linear protrusion or indentation.

Figure 5:
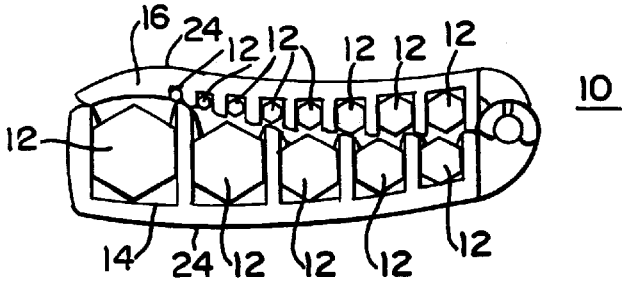
FIG. 5 shows a bottom view of the tool holder of FIG. 1 when tools are present and when the tool holder is in a closed position.

Once the L-keys 12 have been inserted into the proper channels 26, the panel 14 can be pivoted to the closed position shown in FIGS. 5–7 and the panels locked. As shown in FIG. 3, locking of the panels 14 and 16 is accomplished when the pair of vertically extending bumps or protrusions 41 formed in the panel 16 and posts 20 are captured in corresponding C-shaped openings 43 formed in the hinges 18. The closed tool holder 10 provides an ergonomically friendly structure that allows the tool holder 10 to be easily carried in one hand.

An L-key 12 held by the tool holder 10 can be removed therefrom in several ways. One way is to grasp the short leg 36 of the desired L-key 12 and pull the long leg 40 through the channel 26. Another way of removing the L-key is to open the tool holder 10 (see FIG. 1) and pull the short leg 36 perpendicular from the channel 26 past the ribs 28. Once the L-key is removed, the handle 21 is removed by unsnapping the edge 25 from the hook 23.

Figure 8A:
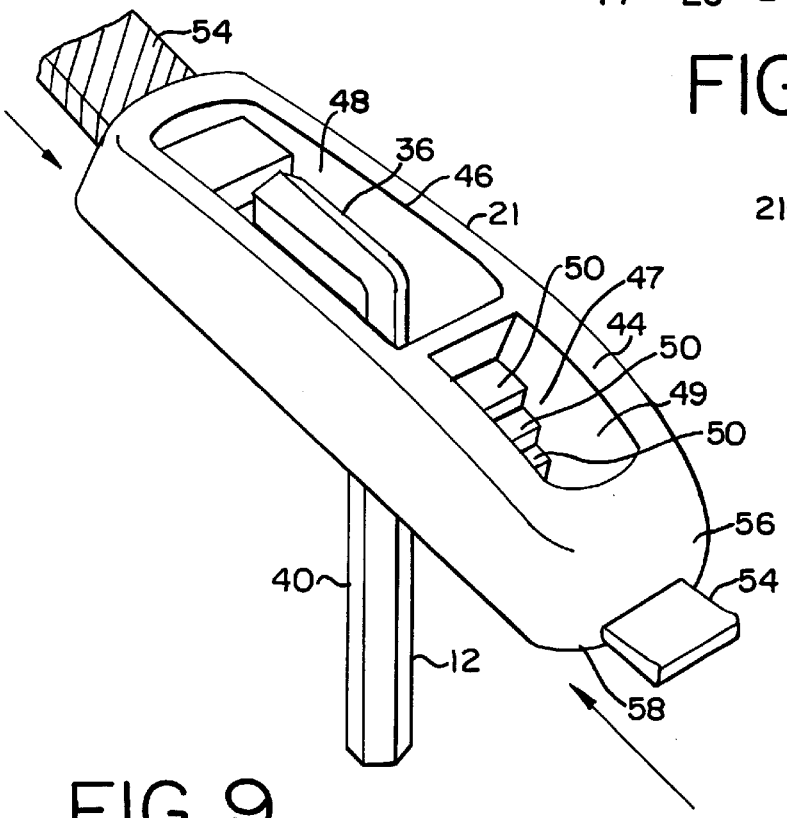
FIG. 8A shows a top perspective view of the handle of FIGS. 6 and 7.
Figure 8B:
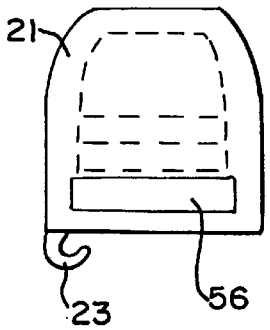
FIG. 8B shows an end view of the handle of FIG. 8A.

As shown in FIG. 8A, the handle 21 has a body 44 that is made of a sturdy material, such as the thermoplastic sold by Monsanto under the trademark SANTOPRENE or other thermoplastics such as polypropylene or nylon, and has a length of approximately 4.5", a width of approximately 1" and a height of approximately 1". The body 44 may also be made by the process of reaction injection molding. A pair of rectangular recesses 48 and 49 are formed in the body 44, where recess 48 has a length of approximately 2.25", a width of approximately 5/8" and a maximum depth of approximately 0.75". Recess 49 is designed to contain smaller L-keys than recess 48 and has a length of approximately 1½", a width of approximately ½" and a maximum depth of approximately 0.75". A pair of openings 46 and 47 are formed in the rectangular recesses 48 and 49, respectively, of the body 44 and are designed to receive and lock a tool, such as L-key 12, therein. The openings 46 and 47 are each formed in the same end of their respective recess. Each of the openings 46 and 47 preferably has a width of approximately 0.375" and a depth of approximately 0.25'.

Figure 9:
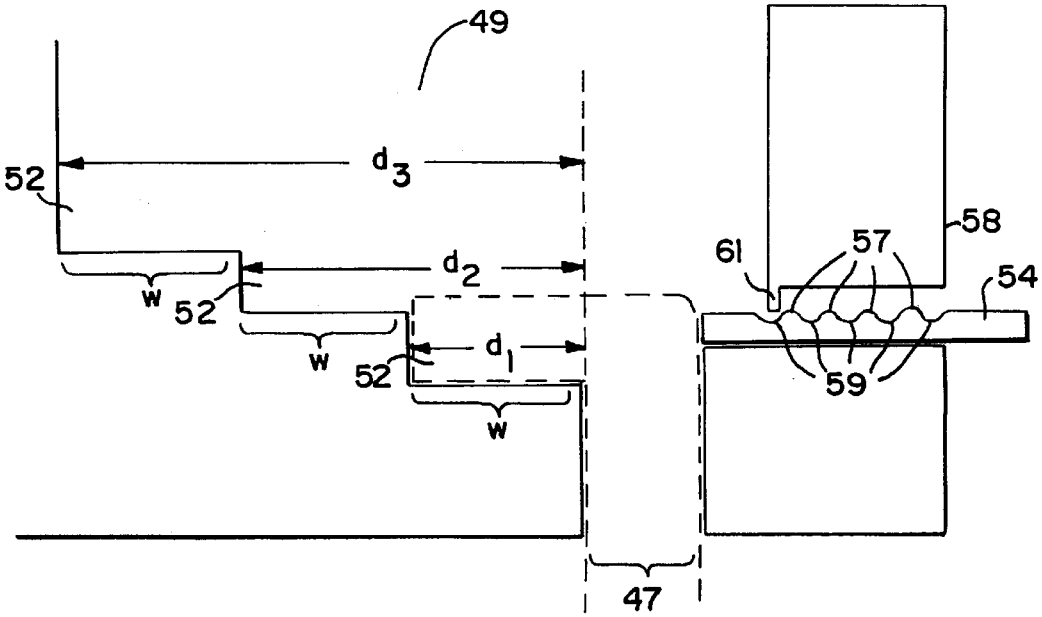
FIG. 9 schematically shows a cross-section of a portion of the handle of FIG. 8.
Figure 10:
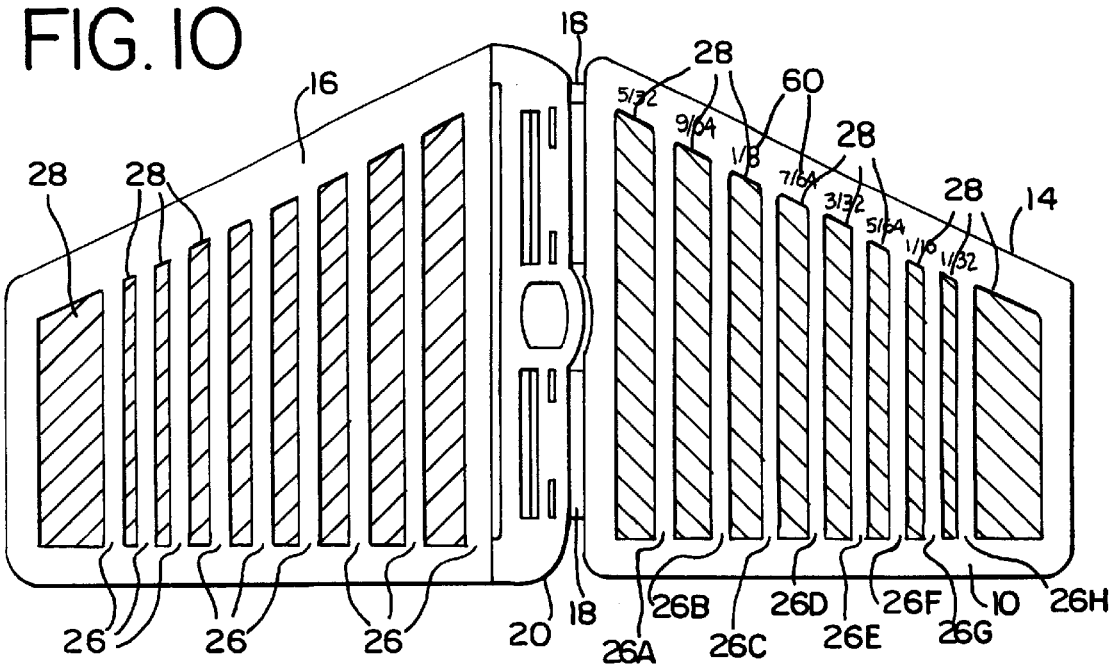
FIG. 10 shows an interior open side view of a second embodiment of a tool holder according to the present invention.
Figure 11:
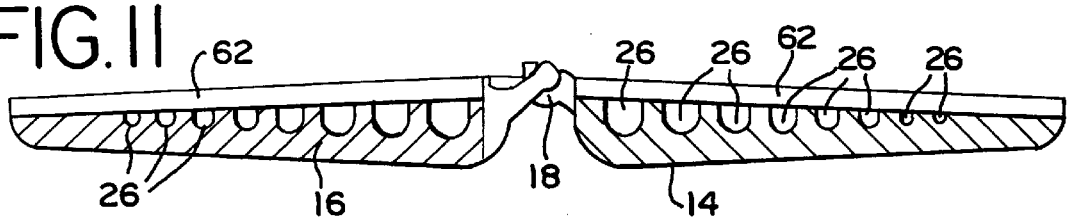
FIG. 11 shows a bottom view of the tool holder of FIG. 10.

For the purpose of illustration, the structure of the recess 48 and the insertion of an L-key 12 into opening 46 will be described below. The following explanation is equally applicable to the structure of the recess 49 and the insertion of an L-key into recess 49 and opening 46. As shown in FIG. 8A, the long leg 40 of the selected L-key 12 is inserted into and through the recess 48 and opening 46. The long leg 40 extends through the opening 46 to such an extent that the short leg 36 of the selected L-key enters the recess 48 and lies flat against a planar ledge 50 that is associated with the selected L-key. As shown in FIGS. 8A and 9, there a plurality of such planar ledges 50 which are arranged in a step-like pattern where the height of the steps are approximately ⅛" for opening 47 and approximately 3⁄16" for opening 46. Each ledge 50 is rectangular in shape having a length of approximately 0.375" where the distance, d, from the edge of the opening 47 to each rear edge 52 of a ledge 50 varies, depending on the size of L-key it is to support. Varying the distance, d ($d_1$, $d_2$, $d_3$) takes into account the varying lengths of the short legs 36 and allows the face 34 of the short legs 36 to lie adjacent to the rear edge 52 of the ledge 50. The widths, w, of the ledges may be constant (5⁄16" for opening 47 and ½" for opening for opening 46) or vary depending on the size of the L-keys to be inserted into the handle 21. Examples of L-keys and the respective short leg lengths and corresponding distances d are given in the table below:

| Width of L-key (in.) | Long Leg (in.) | Short Leg (in.) | d (in.) |
|---|---|---|---|
| 0.28 | 1.125 | 0.125 | 0.125 |
| 0.35 | 1.125 | 0.250 | 0.250 |
| 0.50 | 1.75 | 0.625 | 0.625 |

Figure 14:
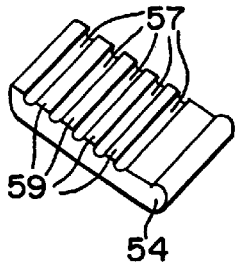
FIG. 14 shows a perspective view of a slide to be used with the handle of FIGS. 8 and 12A.

Once the selected L-key 12 is inserted into the opening 46 and recess 48 as described above, a clamping mechanism, such as rectangular slide 54, is slid within slot 56 formed in the body 44 along a direction that is perpendicular to the axis of the opening 46. The slot 56 has a rectangular cross-section so as to snugly receive the slide 54. As shown in FIG. 14, the top surface of the slide 54 has a plurality of ribs 57 and grooves 59 therebetween whose function will be described below. The slot 56 extends from an edge 58 of the body 44 to the recess 48. When the slide 54 is fully extended into the slot 56 an end portion of approximately 0.25" still lies outside the edge 58 of the body 44. Consequently, when the slide 54 shown in FIG. 8A is slid to the left (see arrow), it enters the recess 49 and engages the L-key 12. The slide 54 is locked in place since the grooves 59 are spaced so that a downwardly extending protrusion 61 is inserted into a groove 59 when the slide 54 engages an L-key 12. Once the L-key 12 is held in place by the slide 54, the operator can grasp the body 44, insert the face 38 of the L-key into a hex nut and rotate the body 44 in a manner similar to a T-handle.

A second embodiment of a tool holder 10 is shown in FIGS. 10–15. Like the tool holder of FIGS. 1–9, the tool holder 10 of FIG. 10 has a pair of panels 14, 16 that are hingedly attached to one another. The panels 14 and 16 have substantially the same shape, structure and function as the panels 14 and 16 of the tool holder 10 of FIGS. 1–9. One difference is that the panels have a less curved shape and have indicia 60 to identify where the L-keys 12 are to be stored. Another difference is that panel 14 has an top and bottom edges 62 enclose the C-shaped channels 26 so that a tool must be inserted through the opening defined by a channel and the edge 62.

Figure 15A:
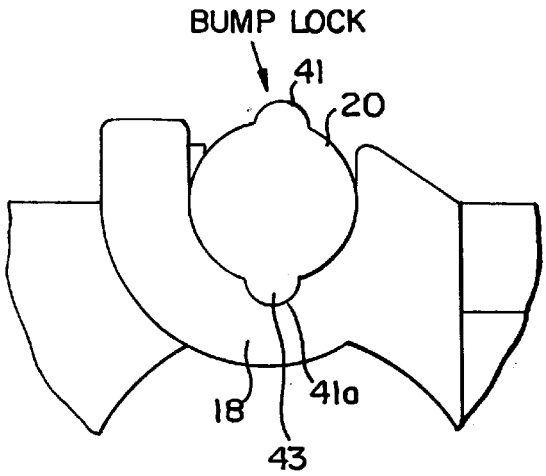
FIG. 15A shows an enlarged view of the attachment between the panels of the tool holders of FIGS. 1 and 10 when in an open position.
Figure 15B:
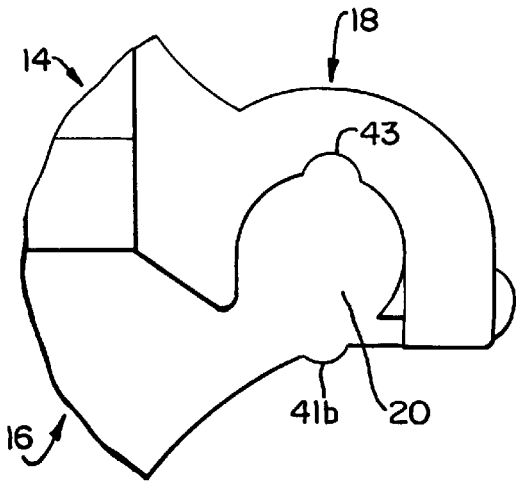
FIG. 15B shows an enlarged view of the attachment between the panels of the tool holders of FIGS. 1 and 10 when in a closed position.

When the panels 14 and 16 are fully opened (see FIGS. 10 and 11), the panels are locked in place. As shown in FIG. 15A, each post 20 of panel 16 has a bump or protrusion 41*a* that extends along the length of the post 20. At the open position, the bumps 41*a* are inserted into and engage corresponding C-shaped openings 43 formed in the hinges 18 so as to lock the panels. Locking of the panels 14 and 16 at the closed position is accomplished in a similar manner in that a second set of bumps or protrusions 41*b* engage the openings 43 at the closed position, as shown in FIG. 15B. The bumps 41*b* preferably have the same shape as bumps 41*a* and are located on the opposite side of the post 20.

A handle 21 is removably attached to the tool holder 10 in the same manner as the handle of FIGS. 6–9. In particular, the hook 23 engages the edge 25 of the hang hole 27 formed in the panel 16. When the handle 21 is removed from the panels it can be used as a T-handle for an L-key as described previously with respect to the handle 21 of FIGS. 6–9.

Figure 12A:
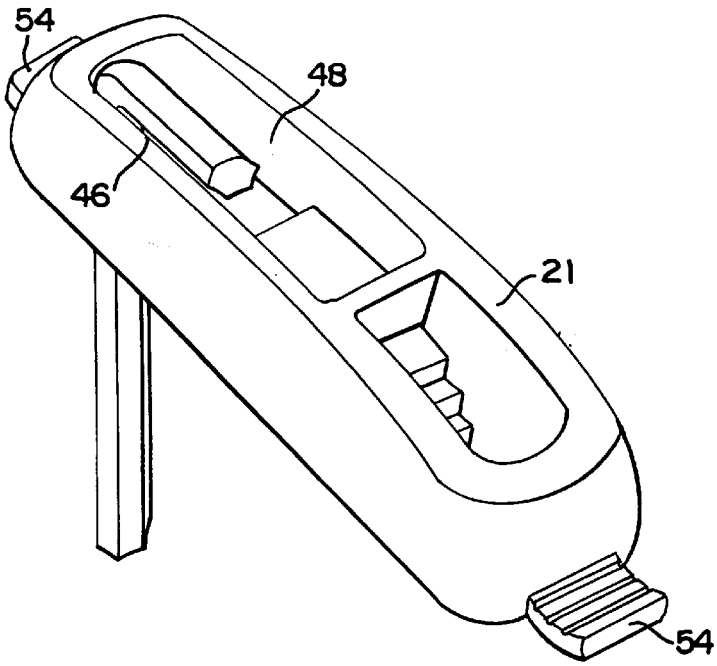
FIG. 12A shows a perspective view of the handle of FIG. 10.
Figure 12B:
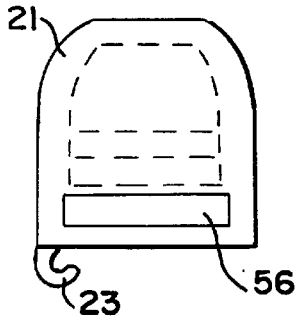
FIG. 12B shows an end view of the handle of FIG. 12A.
Figure 13:
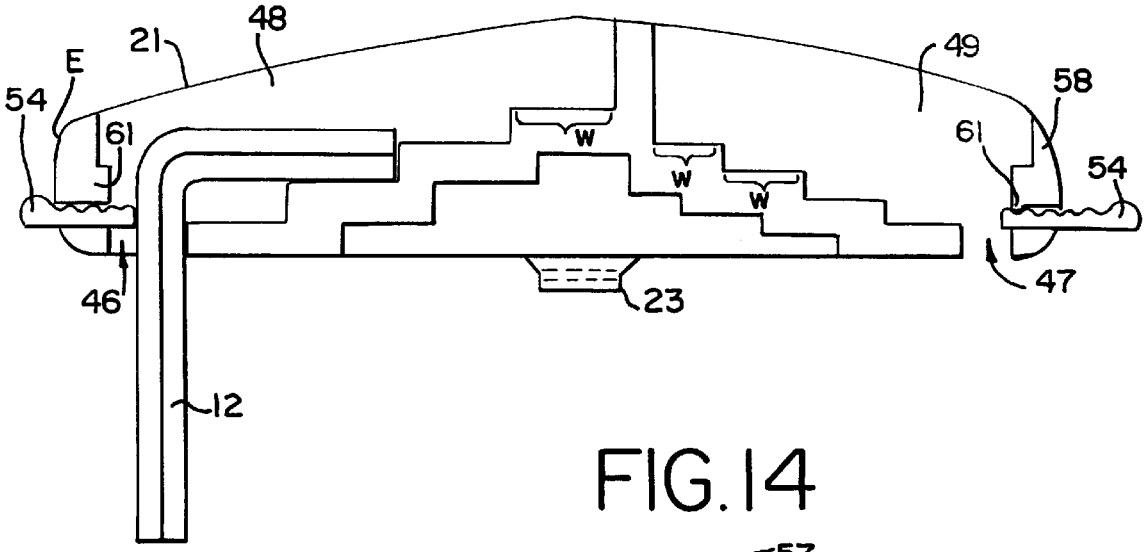
FIG. 13 schematically shows a cross-section of a portion of the handle of FIG. 12A.

As shown in FIGS. 12–14, the handle 21 has substantially the same shape, structure and function as the handle 21 of FIGS. 6–9. There are two significant differences in that the handle 21 of FIGS. 12–14 has an additional ledge 50 and the ledges 50 of recess 48 progressively rise going from the edge E towards the center of the handle 21. This means that the opening 46 is located near the edge E instead of near the center as in the embodiment of FIGS. 6–9.

The foregoing description is provided to illustrate the invention, and is not to be construed as a limitation. Numerous additions, substitutions and other changes can be made to the invention without departing from its scope as set forth in the appended claims.

We claim:

1. A tool holder comprising:

a first panel comprising a first side and a second side that faces opposite to said first side, wherein said first side comprises a first open channel extending along a first direction from one end of said first side to a second end of said first side and having a first diameter along the entire length of said first open channel as measured perpendicular to said first direction; and wherein said first side comprises a second channel having a second diameter that is different in magnitude than said first diameter.

2. The tool holder of claim 1, wherein said second channel extends along said first direction and has a second diameter as measured perpendicular to said first direction.

3. The tool holder of claim 2, wherein said first open channel is parallel to said second channel.

4. The tool holder of claim 1, further comprising:

a second panel attached to said first panel and comprising a first side and a second side that faces opposite to said first side.

5. The tool holder of claim 4, comprising a hinge that hingedly attaches said first panel to said second panel so that said first panel pivots relative to said second panel from a closed position to an open position.

6. The tool holder of claim 5, wherein said closed position is achieved when said first side of said first panel is parallel to said first side of said second panel.

7. The tool holder of claim 4, wherein said first side of said second panel comprises a first channel extending along said first direction.

8. The tool holder of claim 6, wherein said first side of said second panel comprises a first open channel extending along said first direction and wherein an opening defined by said first open channel of said first panel faces an opening defined by said first channel of said second panel when said first panel is located at said closed position.

9. The tool holder of claim 6, said first panel comprising a rib interposed between and adjacent to said first open channel and said second channel of said first panel.

10. The tool holder of claim 9, wherein said first side of said second panel comprises a first open channel extending along said first direction and wherein the entire portion of an opening defined by said first channel of said second panel faces said rib when said first panel is located at said closed position.

11. A tool holder comprising:

a first panel comprising a first side and a second side that faces opposite to said first side, wherein said first side comprises a first open channel extending along a first direction and having a first diameter as measured perpendicular to said first direction; and wherein said first side comprises a second channel having a second diameter that is different in magnitude than said first diameter; and a handle detachably connected to said first panel.

12. The tool holder of claim 11, wherein said handle comprises an opening to receive and lock a tool therein.

13. A tool holder comprising:

a first panel comprising a first side and a second side that faces opposite to said first side, wherein said first side comprises a first open channel extending along a first direction and having a first diameter as measured perpendicular to said first direction; and wherein said first side comprises a second channel having a second diameter that is different in magnitude than said first diameter;

a second panel attached to said first panel and comprising a first side and a second side that faces opposite to said first side;

a hinge that hingedly attaches said first panel to said second panel so that said first panel pivots relative to said second panel from a closed position to an open position; and a handle detachably connected to said hinge.

14. The tool holder of claim 13, wherein said handle comprises an opening to receive and lock a tool therein.

15. A tool holder comprising:

a first panel comprising a first open channel extending along a first direction from one end of said first panel to a second end of said first panel and having a first diameter along the entire length of said first open channel as measured perpendicular to said first direction; and;

a second panel attached to said first panel and comprising a second open channel, wherein said first and second open channels have openings that face in directions opposite from one another.

16. The tool holder of claim 15, wherein said openings of said first and second open channels face one another.

17. The tool holder of claim 15, wherein said openings of said first and second open channels are offset from one another.

18. The tool holder of claim 15, wherein said first panel comprises a plurality of open channels and said second panel comprises a plurality of open channels, wherein no two open channels in said first and second panel have a diameter with the same magnitude as measured perpendicular to said first direction.

19. The tool holder of claim 18, wherein one or more of said plurality of open channels of said first panel are offset relative to any of said plurality of open channels of said second open channel.

20. A tool holder comprising:

a first panel comprising a first open channel extending along a first direction;

a second panel attached to said first panel and comprising a second open channel, wherein said first and second open channels have openings that face in directions opposite from one another; and a handle detachably connected to said first panel.

21. The tool holder of claim 20, wherein said handle comprises an opening to receive and lock a tool therein.

22. A tool holder comprising:

a first panel comprising a first side and a second side that faces opposite to said first side, wherein said first side comprises a channel; and wherein said second side comprises an indicating mechanism which indicates where an object will be held in place within said channel.

23. The tool holder of claim 22, wherein said first side comprises a second channel extending along said first direction and having a second diameter as measured perpendicular to said first direction that is different in magnitude than said first diameter.

24. The tool holder of claim 22, further comprising:

a second panel attached to said first panel and comprising a first side and a second side that faces opposite to said first side.

25. The tool holder of claim 24, comprising a hinge that hingedly attaches said first panel to said second panel so that said first panel pivots relative to said second panel from a closed position to an open position.

26. The tool holder of claim 24, wherein said first panel comprises a plurality of channels and said second panel comprises a plurality of channels, wherein no two channels in said first and second panel have a diameter with the same magnitude.

27. A tool holder comprising:

a first panel comprising a first side and a second side that faces opposite to said first side, wherein said first side comprises a channel; wherein said second side comprises an indicating mechanism which indicates where an object will be held in place within said channel; and a handle detachably connected to said first panel.

28. The tool holder of claim 27, wherein said handle comprises an opening to receive and lock a tool thereto.

29. A tool holder comprising:

a first panel comprising a hinge element and a first open channel extending along a first direction from one end of said first panel to a second end of said first panel and having a first diameter along the entire length of said first open channel as measured perpendicular to said first direction;

a second panel comprising a post which is inserted into said hinge element so that said first panel pivots about said post from an open position to a closed position; and a locking mechanism that is attached to said post and which engages said first panel at said closed position.

30. The tool holder of claim 29, wherein said locking mechanism comprises a protuberance and said element hinge comprises an opening that is engaged by said protuberance at said closed position.

31. The tool holder of claim 30, wherein said protuberance is vertical.

32. A tool holder comprising:

a first panel comprising a hinge element;

a second panel comprising a post which is inserted into said hinge element so that said first panel pivots about said post from an open position to a closed position; and a locking mechanism that is attached to said post and which engages said first panel at said closed position, wherein said locking mechanism comprises a protuberance and a second protuberance and said hinge element comprises an opening that is engaged by said protuberance at said closed position and is engaged by said second protuberance at said open position.

33. The tool holder of claim 32, wherein said first and second protuberances extend along the length of said post and are located on opposite sides of said post.

34. The tool holder of claim 1, wherein said first open channel is permanently accessible for entry therein.

35. The tool holder of claim 1, wherein there are no clamps attached to said tool holder.

36. The tool holder of claim 15, wherein said first open channel is permanently accessible for entry therein.

37. The tool holder of claim 15, wherein there are no clamps attached to said tool holder.

38. The tool holder of claim 22, wherein said channel is permanently accessible for entry therein.

39. The tool holder of claim 22, wherein there are no clamps attached to said tool holder.

40. A tool holder comprising:

a first panel comprising a first side and a second side that faces opposite to said first side, wherein said first side comprises a first open channel extending along a first direction and having a first diameter as measured perpendicular to said first direction; and wherein said first side comprises a second channel having a second diameter that is different in magnitude than said first diameter; and a handle detachably connected to said first panel, wherein said handle comprises an opening to receive and lock a tool therein.

41. A tool holder comprising:

a first panel comprising a first side and a second side that faces opposite to said first side, wherein said first side comprises a first open channel extending along a first direction and having a first diameter as measured perpendicular to said first direction; and wherein said first side comprises a second channel having a second diameter that is different in magnitude than said first diameter;

a second panel attached to said first panel and comprising a first side and a second side that faces opposite to said first side;

a hinge that hingedly attaches said first panel to said second panel so that said first panel pivots relative to said second panel from a closed position to an open position; and a handle connected to said hinge, wherein said handle comprises an opening to receive and lock a tool therein.

42. A tool holder comprising:

a first panel comprising a first open channel extending along a first direction;

a second panel attached to said first panel and comprising a second open channel, wherein said first and second open channels have openings that face in directions opposite from one another; and a handle connected to said first panel, wherein said handle comprises an opening to receive and lock a tool therein.

43. A tool holder comprising:

a first panel comprising a first side and a second side that faces opposite to said first side, wherein said first side comprises a channel; wherein said second side comprises an indicating mechanism which indicates where an object will be held in place within said channel; and a handle connected to said first panel, wherein said handle comprises an opening to receive and lock a tool thereto.

* * * * *

UNITED STATES PATENT AND TRADEMARK OFFICE

CERTIFICATE OF CORRECTION

PATENT NO. : 6,032,796

DATED : March 7, 2000

INVENTOR(S) : Ryan Keith Hopper et al.

It is certified that error appears in the above-identified patent and that said Letters Patent is hereby corrected as shown below:

On the Title Page

In column 1, item [75], delete "Beatrice" and substitute --Grand Island-- in its place.

In the Claims

In claim 30, lines 2 and 3, delete "element hinge" and substitute --hinge element-- in its place.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*